US005637170A

United States Patent [19]

Rodriguez

[11] Patent Number: 5,637,170

[45] Date of Patent: Jun. 10, 1997

[54] TRANSFER TAPE ASSEMBLY FOR CUTTING AND SPOOLING A WEB OF PAPER

[76] Inventor: Peter A. Rodriguez, 1785 Selva Marina Dr., Atlantic Beach, Fla. 32233

[21] Appl. No.: 533,092

[22] Filed: Sep. 25, 1995

Related U.S. Application Data

[63] Continuation-in-part of Ser. No. 131,082, Oct. 1, 1993, Pat. No. 5,453,141.

[51] Int. Cl.[6] ..... B65H 19/00

[52] U.S. Cl. ..... 156/184; 156/187; 242/521

[58] Field of Search ..... 156/184, 185, 156/187, 190, 191, 192, 193, 446, 447; 242/521, 522, 526.2; 428/40, 41, 42, 343

[56] References Cited

U.S. PATENT DOCUMENTS

| | | | |
|---|---|---|---|
| 2,889,922 | 6/1959 | Clarvoe | 206/56 |
| 4,100,681 | 7/1978 | Hollander | 428/40 |
| 4,414,258 | 11/1983 | Corbin, Sr. | 242/526.2 X |
| 4,659,029 | 4/1987 | Rodriguez | 242/56 R |
| 5,277,731 | 1/1994 | Krimsky et al. | 242/554.2 X |
| 5,453,141 | 9/1995 | Rodriguez | 156/184 |

*Primary Examiner*—James Engel
*Attorney, Agent, or Firm*—Arthur G. Yeager

[57] ABSTRACT

An elongate transfer tape assembly includes a water-resistant removable top and bottom liner with two adhesive strips, one which may be water soluble, the other water-resistant, between the liners and mounted on opposite sides of a carrier. The carrier preferably is wider than the adhesives to provide mechanized gripping area remote from the edge of the assembly being fed into the nip between a collecting spool and web drive roller. A water carrying pad preferably is mounted on the bottom of the carrier that when forced against paper by insertion into the nip will weaken the paper by contact with the pad or expulsion of water from the pad. Water may also be carried by the water soluble adhesive that is applied to the bottom of the carrier in lieu of the pad. The paper will attach to the tape assembly and be drawn to a collecting spool to which the tape assembly is attached. The paper will break along its weakened portion.

20 Claims, 2 Drawing Sheets

TRANSFER TAPE ASSEMBLY FOR CUTTING AND SPOOLING A WEB OF PAPER

BACKGROUND OF THE INVENTION

Related Application

The present application is a continuation-in-part of Ser. No. 08/131,082 filed Oct. 1, 1993 entitled "TRANSFER TAPE AND METHOD FOR CUTTING AND SPOOLING A WEB OF PAPER" now U.S. Pat. No. 5,453,141.

FIELD OF THE INVENTION

The present invention relates to an improvement in apparatus for cutting and spooling a traveling web or sheet of paper in the paper making and converting industry and particularly to cutting a web and transferring it to an empty spool.

PRIOR ART

It is common practice in the paper industry to wind a continuous sheet or web of paper onto a rotating spool and then to cut the sheet and begin winding the paper onto another spool. Modern technology requires the cutting and spooling to be done in the shortest possible time that is reliable, economical, and safe for the reason that paper-making technology provides a continuous sheet of paper. An example of one technique used for cutting and spooling is described in applicants' U.S. Pat. No. 4,659,029. An improved technique specifically adapted for use in tissue, ground-wood paper and the like is disclosed herein. See also applicant's prior application referenced hereinabove.

SUMMARY OF THE INVENTION

In accord with the present invention there is provided a transfer tape assembly for severing a traveling web of paper and transferring the web of paper to an empty spool comprising a planar carrier having an upper surface and a lower surface and a front edge portion and a rear edge portion, a first and second planar elongate adhesive member supported by the carrier means, the first adhesive member having an inner surface affixed to the carrier means forwardly on the top surface adjacent the front edge portion thereof and an outer surface bindable to an empty spool. The second adhesive member has an inner surface affixed to the carrier means on the bottom surface thereof and an outer surface bindable to a traveling web of paper. Preferably the second adhesive member is spaced rearwardly of the first adhesive member intermediate the front and rear edge portions of the carrier.

Additionally, the tape assembly may include weakening means, which may consist of an elongate water carrying means supported by the outer surface of the second adhesive member for carrying water. This weakening means engages a web of paper as an empty spool carrying the tape assembly rotatably engages a paper web. The weakening means for some thin paper webs may include a tenacious adhesive that binds to a paper web upon engagement therewith and causes a weakening separation of the paper web as the web stretches by the changed direction onto the empty spool; i.e., the binding of the adhesive onto the web does not detach from the spool during the transfer of the web onto the empty spool. The weakening means may include a water carrying adhesive, like a water soluble adhesive. Also included is a releasable liner overlying at least one of the outer surfaces of the adhesive members. The weakening means may include a pad of water-retaining or compressible material or a pad having a substantially thin rectangular cross-sectional shape, or alternately, a plurality of elements, each element being formed of water-retaining or absorbent compressible material. In another embodiment, the weakening means includes a generally elongate partially compressible rib member and an elongate pad member overlying the rib member to substantially enclose the rib member between the pad member and the inner surface to affix the rib member and the pad member thereto in a manner described in my U.S. Pat. No. 5,453,141.

The rear edge portion includes means for mechanical positioning of the tape assembly, the first adhesive member being carried by the front edge portion. The means for mechanical positioning may include a series of indexed perforations along the rear edge portion. A plurality of score or crease lines formed laterally across the tape assembly and extending between the front and rear edge portions may divide the tape assembly into a plurality of foldable sections for dividing the tape assembly into separable portions.

In accord with this invention an improved method is disclosed for severing a traveling web of paper being wound on a spool with the web being driven by a drive roller and transferring the moving web of paper after severing to an empty spool includes the steps of providing an elongate tape assembly having an elongate carrier with one side attachable to an empty spool via a first adhesive element disposed adjacent a front edge portion of the carrier and carrying an elongate weakening and attachment means on the other side of the carrier adjacent the first element that is bindable to the web of paper; positioning the empty spool in contact with the web of paper after the empty spool is rotated sufficiently so that its outer surface is substantially at the same speed as the travelling web of paper; feeding the elongate tape assembly with the front edge portion forwardly between the web of paper and the empty spool to cause the first adhesive to adhere to the spool and to cause the weakening and attachment means to firmly grip the web of paper and sever the web of paper therealong; and winding the severed web of paper onto the empty spool.

The method may have the carrier, as including a rearward end portion free of any of the first adhesive element and the weakening and attachment means, further include the step of grasping the rearward end portion of the carrier for feeding the carrier across the web prior to the above feeding step.

The method also may position the weakening and attachment means spaced rearwardly from the first adhesive element and forwardly of the rear edge portion of the carrier and the above feeding step includes the step of attaching the first element to the empty spool prior to firmly gripping the web of paper. For some webs of paper the weakening and attachment means may include a tenacious adhesive and the feeding step includes the step of passing the tenacious adhesive onto the web between the empty spool and the drive roller to firmly grip the web and cause the web of paper to change direction and stretch to sever the web and transfer to the empty spool. When the weakening and attachment means includes an adhesive and a water carrying element, and the feeding step includes the step of passing the water carrying element onto the web between the empty spool and the drive roller to weaken the web of paper forwardly of adhesively attaching the tape assembly to the web of paper which is transferred to the empty spool. For some webs of paper the method may include the step of applying water to the weakening and attachment means before the above feeding step, and wherein the above feeding step includes transferring water into the web of paper to weaken same.

BRIEF DESCRIPTION OF THE DRAWINGS

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings, in which:

DETAILED DESCRIPTION OF THE PREFERRED EMBODIMENT

Figure 1:
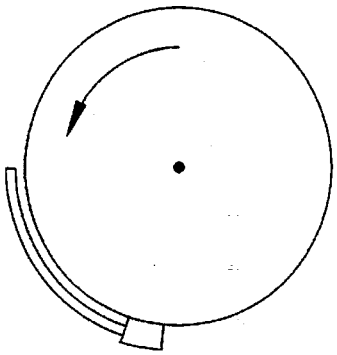
FIGS. 1 and 2 are diagrammatic views of one embodiment of applicant's prior transfer tape.
Figure 2:
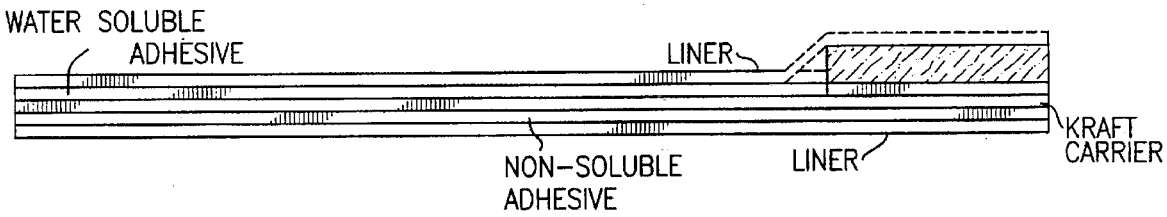

With reference now to the drawings, side diagrammatic views of the transfer tape in accord with applicant's prior application are depicted in FIGS. 1 and 2. An upper, outer liner is preferably a thin sheet of water-resistant releasable material such as silicone, is used to cover a first planar strip or sheet of an adhesive member that will not bind to the liner. A pad of water absorbent material is mounted to the first strip. A lower, inner liner is also a thin sheet of water-resistant releasable material. The adhesive member also includes a second strip of water-resistant adhesive material.

My prior pad is used as a weakening means to provide for the severing of the web of paper during transfer of the paper to an empty takeup spool. The pad material and geometry used in a particular application depends on the type of paper that is to be cut.

My prior pad has a generally rectangular cross-sectional shape and is preferably made of a material such as the fibrous pulp-like material found in blotter paper and the like that will hold water when wet. The pad is designed to hold water even under substantial centrifugal force for reasons that will be discussed hereinbelow.

Figure 3:
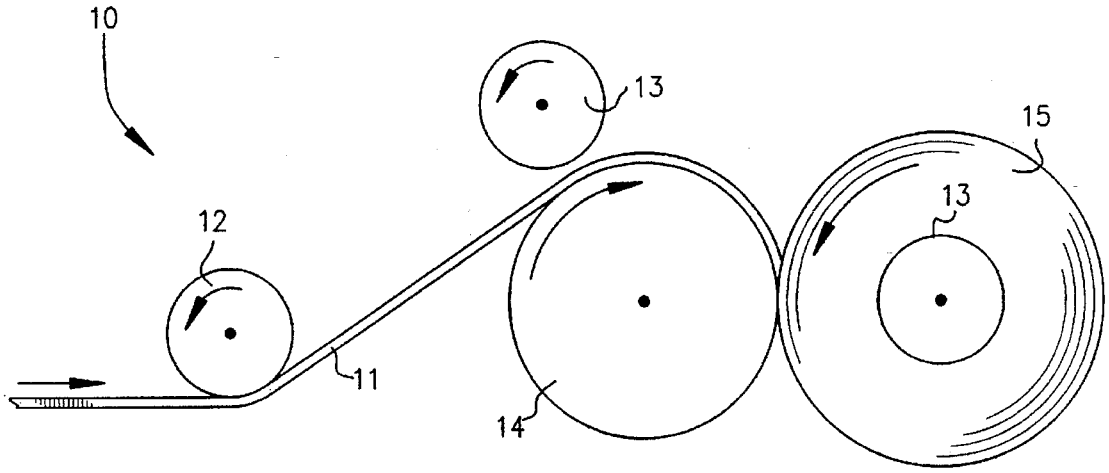
FIG. 3 is a side diagrammatic view of rollers and takeup spools in a typical paper-winding technology.

FIG. 3 illustrates the use of my prior tape in transferring a paper-rolling process from one spool to another. Paper 11 is fed from the paper making process onto a first and second roller 12 and 14 respectively. A first spool 13 is used to load the paper 11 thereon. When spool 13 is fully loaded, the transfer tape, shown enlarged for clarity, is placed on a second spool 13 as illustrated in FIG. 1.

With my prior tape attached, spool 13, rotating at the same speed as roller 14, is brought into contact with roller 14. The paper 11 is squeezed by the contact pressure and the water carried by tape pad will be forced outwardly into paper 11 thus quickly weakening it substantially. The paper 11, which has adhered to the outer surface of the adhesive, will break along a transverse line due to the change in direction of travel of the paper onto spool 13. The paper 11 will then be taken up by spool 13 which will then be moved into the proper secondary position for continued winding operation. Full spool 15 is moved away.

The above description employs the tape placed on the spool 13 transverse of the direction of movement of the paper 11. It is to be understood that other arrangements may be used such as diagonal or helical as may be appropriate in a particular application.

The principal requirements for the adhesive material used are (1) the outer surface of the adhesive must be able to bind to wet or dry paper; (2) the inner surface of the adhesive must be able to bind to the surface of a spool; and (3) the pad binding adhesive should not degrade in water. The tape is normally supplied as a roll and the number and type of liners used depend upon the adhesives used and the need to prevent dust and water from adhering to the tape.

U.S. Pat. No. 5,453,141 describes a laminated tape made up of various adhesives, their release liners, and an absorbent fiber that carries water. This was conceived as a composite tape roughly 2½" to 3" wide. It was intended to apply the composite tape to the surface of the spool prior to contact with the web or spinning up to speed. After the spool matches the surface speed of the web, the spool is brought into contact with the web on the surface of the reel drum. This action forms the nip required to press the moisture out of the absorbent fiber and into the web, thereby weakening the web. After the web is weakened, it is picked up by the adhesive and drawn up and around the spool, while that portion of the web preceding the transfer tape through the nip point separates from the following portion and continues to wrap the jumbo roll.

IMPROVED TRANSFER TAPE OVERVIEW

Improvements in my transfer tape are needed because (1) the transfer tape might not survive the face-to-face rolling contact of the prepared spools as they sit in a storage rack, (2) the manual application of the transfer tape to each spool immediately prior to each turn-up lacked the degree of automation needed to be efficient; and (3) if the web breaks prior to the full transfer to the empty spool, the empty spool carrying my prior tape would need to be removed from the primary arms and replaced by another clean spool without adhesives.

My prior transfer tape is only 3" wide. In a typical application, the reel drum is 36" in diameter and the spool is 12" in diameter. This allows only 1" clearance between the rolls at a point 3" away from the nip point. This makes it very difficult to design an efficient delivery mechanism that will hold the transfer tape until it is caught by the nip. Dropping the transfer tape onto the web and allowing the web to carry it into the nip could not be done because of two other problems: (1) the very light webs this product is designed for may not be strong enough to support the falling tape; and (2) tape-like materials in free-fall are impossible to control, resulting in flutter and twists.

By increasing the width of the transfer tape and spacing the components over this increased width, the problem of delivering the material to the nip under constant control is solved. The improvement includes a carrier sheet that is used to mount and space the original transfer tape components and to feed into the nip between the empty roll 13 and drive roller 14.

The adhesive that attaches the improved transfer tape assembly to the new spool is on the top of the leading edge of the carrier sheet so as to be adhered to the spool face as soon as the transfer tape assembly enters the nip between the drive roller or reel drum and spool. The material that carries the tenacious adhesive or the adhesive and water to weaken the web is laminated to the underside of the carrier sheet near its center and faces the web and reel drum.

The order in which the components of the improved transfer tape assembly enter the nip and the functions they perform are as follows: (1) the leading edge of the carrier sheet and the pressure sensitive adhesive bonds transfer tape to the outer surface of spool; (2) the fiber material carries water into the nip which is applied or forced out under compression and wets the paper web; (3) the adhesive adjacent the fiber material forms a secure bond between the material and the carrier sheet; and (4) the trailing edge of carrier sheet provides means of delivering transfer tape to the nip point. For thin papers (2) above may not be necessary if the adhesive in (3) above is tenacious. This order of introduction of each of these components is substantially the same as the order of the referenced application except that the use of a carrier sheet lengthens the time between each successive component's entry to the nip and permits the assembly to lay on the web which guides the assembly into the nip.

The carrier sheet may be similar in handling to continuous fan-fold tractor feed paper commonly used in computer printers. The carrier sheet may have score lines or crease lines or lateral perforations which allows the carrier sheet and the transfer tape assembly components to be conveniently separated into lengths suitable for the particular web width. It may be provided with registration marks that indicate the positions of the perforations for automatic sheet separation. The carrier sheet also may include circular perforations along the trailing edge which provide a means to guide and propel the improved transfer tape across the web with a mechanical delivery system. The perforations may have V-shaped reliefs cut out to the trailing edge of the carrier sheet to prevent small pieces of the carrier sheet from being torn away when the improved transfer tape enters the nip. If the perforations were formed without the reliefs, the margins between the hole and the edge of the carrier sheet may tear away and foul the drive system. The carrier sheet is made of a light cardstock or stiff paper that together with the alternating folds, will not droop when cantilevered from its trailing edge and partially supported by up to ⅓ of its width resting on a pan or tray. This improved transfer tape assembly may be packaged in a protective box by folding in alternating directions. The advantage of this arrangement is that the improved transfer tape assembly can be held by the trailing edge of the carrier sheet much farther away from the nip. This allows much more room for a mechanical delivery system. It also allows the underside of the carrier sheets's leading edge to lie against the web on the surface of the reel drum, which serves to guide the improved transfer tape into the nip with the web without damage to the web.

The concept could also be executed as a non-perforated roll material. The thickness of the laminated materials may perhaps cause difficulties in rolling the material in small enough rolls to be convenient. The material thicknesses define bending radii different than that of the carrier paper itself, thus causing differences in circumference between materials firmly bonded to each other which may cause wrinkles and distortion of the roll.

IMPROVED TRANSFER TAPE

Figure 4:
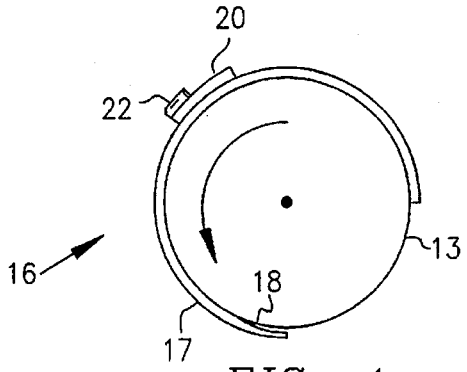
FIG. 4 is a side view of a takeup spool with the transfer tape assembly in accord with the present invention attached thereto.
Figure 5:
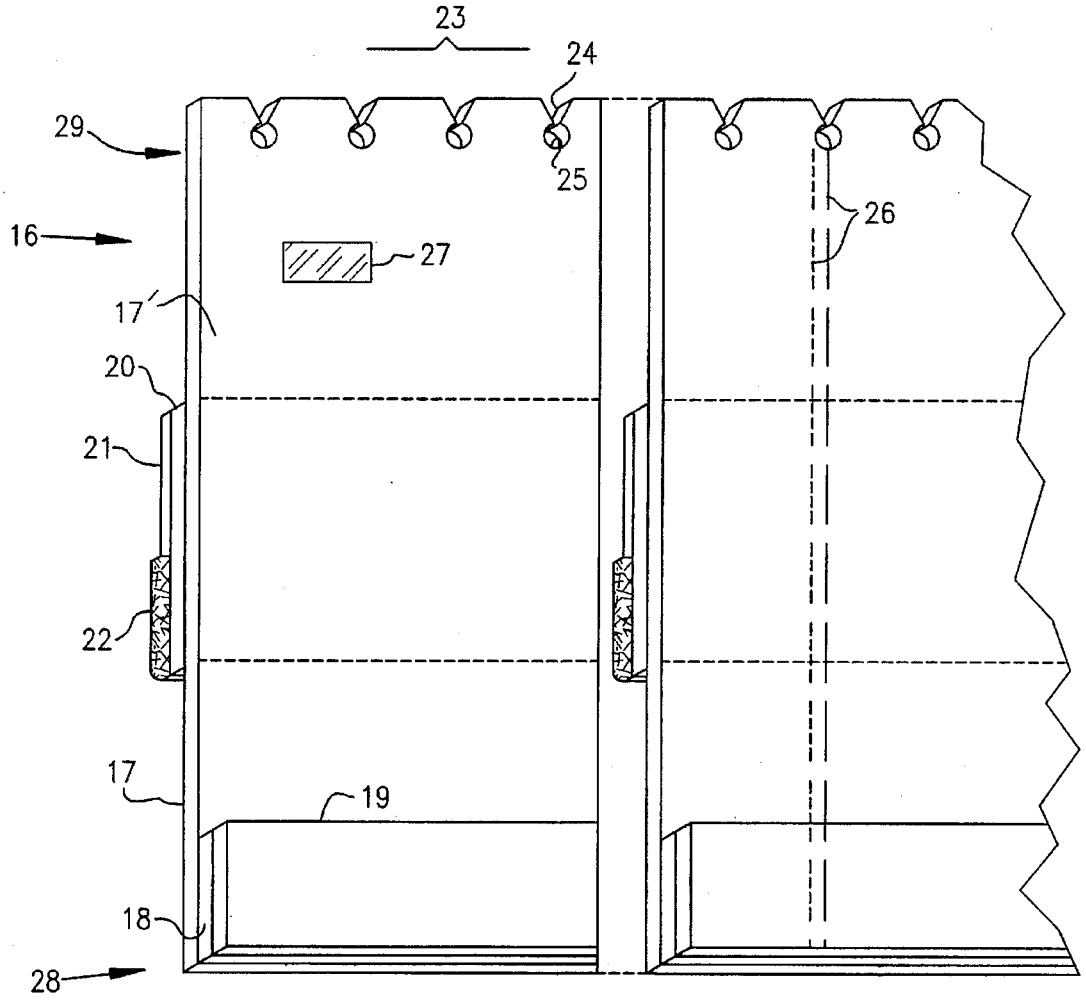
FIG. 5 is a plan diagrammatic view of the tape assembly of FIG. 4.
Figure 6:
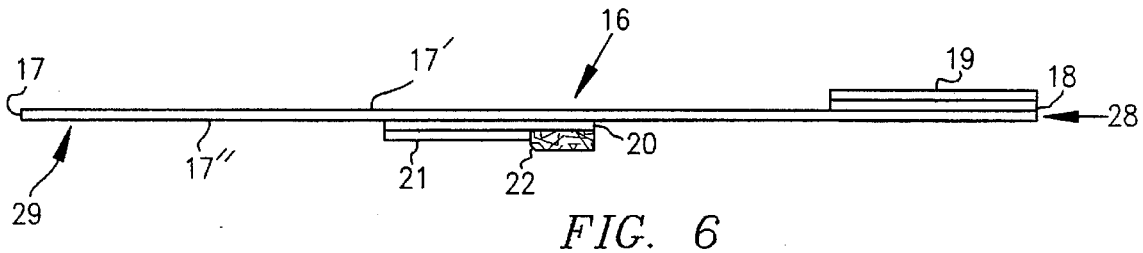
FIG. 6 is a side diagrammatic view of the tape assembly of FIG. 1.

Referring now to the drawings the improved transfer tape assembly 16 is shown, in exaggerated dimensions, attached to the spool 16 in FIG. 4. FIGS. 5 and 6 illustrate the particulars of the improved tape assembly in its preferred embodiment. Tape assembly 16 includes a paper carrier sheet 17 with upper and lower surface 17', 17" respectively. A removable water-resistant strip or liner 19 covers and protects adhesive layer 18. Adhesive layer 18 is made of a pressure-sensitive, substantially water-resistant adhesive material and is mounted adjacent the front or leading edge 28 of the sheet 17 and on the upper surface 17' thereof.

A weakening and attachment means is attached to the lower surface 17' of the carrier sheet 17. The means includes a strip 20 of a tenacious adhesive for some thin paper webs or other adhesive material, which may be of water soluble composition, placed on the lower surface 17" of the sheet 17. The adhesive strip 20 is to be covered by a removable silicone liner 21. The weakening and attachment means for some thicker paper webs preferably includes a water carrying pad 22 attached to adhesive strip 20. Liner 21 may also cover pad 22 to protect it in an alternative embodiment. When pad 22 is used, the adhesive strip 20 may not be water soluble.

The improved pad 22 has a generally rectangular thin cross-sectional shape and is preferably made of a water carrying material, such as a woven filter cloth that will retain water by capillary forces and apply the water to the paper web at the nip without regard to the centrifugal force as my prior tape.

The carrier sheet 17 is constructed with tractor-feed perforations 23 at the rearward or trailing edge 29 made of holes 25 and relief cuts 24 to provide disengagement from the drive system (not shown) without tearing the sheet 17. The length of the sheet 17 used in a given application is defined via lateral score lines or crease lines or perforations 26 which are preformed for a given application and allow for fan-fold packaging.

With reference again to FIG. 4, it can be seen that the front to rear spacing between adhesive 18 and pad 22 on carrier sheet 17 can be varied in a given application by varying the position of the pad 22 on the adhesive strip 20. The exact dimensions of the sheet 17 and the position of pad 22 depends upon, among other things, the diameter of spools 13 and 14 and their respective rotational velocity and the physical distance between them. Other variables considered in the specification of a given transfer tape assembly include type of paper and the width of the web.

As discussed hereinabove, the major advantage obtained by the present invention is greater control of the transfer tape assembly during mechanized handling of the assembly and to also provide that the delivery mechanism is further away from the "nip" or contact point between spools during web transfer. Carrier sheet 17 is preferably made of stiff paper or cardstock and is fan-folded at the crease or score lines or perforations 26 rather than provided on a roll. Perforations 26 also provide a point for separating the assembly into sections.

The separation between the first adhesive member 18 and the second adhesive member or element 20 allows for the lower surface 17" of the carrier sheet 17 under the forward edge 28 to rest on the traveling web to assist in guiding the tape into the nip. The exact dimensions of a particular transfer tape assembly will be derived from the circumstances of a given application and includes consideration of the site of rollers/spools, type of paper involved, and machine speed and other factors.

The illustrated delivery technique utilizes perforations 23 for a tractor-type feed. It is to be understood that other types of feed such as frictional wheel rollers can be used depending upon the circumstances.

It is also to be understood that the pad 22 can be constructed in any of the types shown in the above referenced application FIGS. 6–13 depending upon the type of paper being made in the system.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A transfer tape assembly for severing a traveling web of paper and transferring the web of paper to an empty spool comprising a planar carrier having an upper surface and a lower surface and a front edge portion and a rear edge portion, a first planar elongate adhesive member supported by said carrier, said first adhesive member having an inner surface affixed to said carrier adjacent said front edge portion on said top surface thereof and an outer surface bindable to an empty spool, an elongate weakening and attachment means having an inner surface affixed to said carrier on said bottom surface thereof and said means having an outer surface bindable to a traveling web of paper, said carrier rear edge portion being free from any adhesive to permit grasping thereof for delivery onto a traveling web of paper.

2. The tape assembly as defined in claim 1 wherein said weakening and attachment means includes a water carrying element for maintaining water applied thereto and engaging a web of paper as an empty spool carrying said tape assembly rotatably engages a paper web, said water carrying element applying water so that said weakening means weakens a paper web upon engagement therewith.

3. The tape assembly as defined in claim 2 wherein said water carrying element includes a water soluble adhesive.

4. The tape assembly as defined in claim 2 further including a releasable liner overlying at least one of said outer surfaces.

5. The tape assembly as defined in claim 1 further including a pair of liners of releasable material substantially covering said outer surface of each said adhesive member.

6. The tape assembly as defined in claim 1 wherein said weakening and attachment means includes a pad of water-absorbent compressible material.

7. The tape assembly as defined in claim 1 wherein said weakening and attachment means includes a tenacious adhesive.

8. The tape assembly as defined in claim 7 further including a liner releasably covering said tenacious adhesive.

9. The tape assembly as defined in claim 1 wherein said weakening and attachment means includes a generally elongate adhesive element, said adhesive element attaching a water-carrying member thereto.

10. The tape assembly as defined in claim 1 wherein said rear edge portion includes means for mechanical positioning of said tape assembly, said first adhesive member being carried by said front edge portion.

11. A transfer tape assembly for severing a traveling web of paper and transferring the web of paper to an empty spool comprising a planar carrier having an upper surface and a lower surface and a front edge portion and a rear edge portion, a first planar elongated adhesive member supported by said carrier, said first adhesive member having an inner surface affixed to said carrier on said top surface thereof adjacent a front edge portion and an outer surface bindable to an empty spool, an elongate weakening and attachment means having an inner surface affixed to said carrier on said bottom surface thereof and spaced rearwardly of and separated from said first adhesive member generally medially between said front and rear edge portions, and an outer surface bindable to a traveling web of paper.

12. The tape assembly as defined in claim 11 wherein said carrier rear edge portion is free from any adhesive to permit grasping thereof for delivery onto a traveling web of paper prior to severing of a web and transfer to an empty spool.

13. The tape assembly as defined in claim 11 wherein said weakening and attachment means includes a tenacious adhesive.

14. The tape assembly as defined in claim 11 wherein said weakening and attachment means includes a water carrying element for maintaining water applied thereto and engaging a web of paper as an empty spool carrying said tape assembly rotatably engages a paper web, said water carrying element being adapted to apply water so that said weakening means weakens a paper web upon engagement therewith.

15. An improved method for severing a traveling web of paper being wound on a spool with the web being driven by a drive roller and transferring the moving web of paper after severing to an empty spool comprising the steps of:

A. providing an elongate tape assembly having an elongate carrier with one side attachable to an empty spool via a first adhesive element disposed adjacent a front edge portion of the carrier and carrying an elongate weakening and attachment means on the other side of the carrier adjacent the first element that is bindable to the web of paper;

B. positioning the empty spool in contact with the web of paper after the empty spool is rotated sufficiently so that its outer surface is substantially at the same speed as the travelling web of paper;

C. feeding the elongate tape assembly with the front edge portion forwardly between the web of paper and the empty spool to cause the first adhesive to adhere to the spool and to cause the weakening and attachment means to firmly grip the web of paper and sever the web of paper therealong; and D. winding the severed web of paper onto the empty spool.

16. The method of claim 15 wherein the carrier includes a rearward end portion free of any of the first adhesive element and the weakening and attachment means further comprising the step of:

E. grasping the rearward end portion of the carrier for feeding the carrier across the web prior to step C.

17. The method of claim 15 wherein the weakening and attachment means is spaced rearwardly from the first adhesive element and forwardly of the rear edge portion of the carrier and wherein step C includes the step of:

E. attaching the first element to the empty spool prior to firmly gripping the web of paper.

18. The method of claim 15 wherein the weakening and attachment means includes a tenacious adhesive and wherein step C includes the step of:

E. passing the tenacious adhesive onto the web between the empty spool and the drive roller to firmly grip the web and cause the web of paper to change direction and stretch to sever the web and transfer to the empty spool.

19. The method of claim 15 wherein the weakening and attachment means includes an adhesive and a water carrying element, and wherein step C includes the step of:

E. passing the water carrying element onto the web between the empty spool and the drive roller to weaken the web of paper forwardly of adhesively attaching the tape assembly to the web of paper which is transferred to the empty spool.

20. The method of claim 15 further comprising the step of:

E. applying water to the weakening and attachment means before step C, and wherein step C includes transferring water into the web of paper to weaken same.

* * * * *